US012319888B2

(12) United States Patent
Reddyhoff

(10) Patent No.: US 12,319,888 B2
(45) Date of Patent: Jun. 3, 2025

(54) LUBRICANT COMPOSITIONS

(71) Applicant: Imperial College Innovations Limited, London (GB)

(72) Inventor: Thomas Reddyhoff, London (GB)

(73) Assignee: IMPERIAL COLLEGE OF SCIENCE, TECHNOLOGY AND MEDICINE, London (GB)

( * ) Notice: Subject to any disclaimer, the term of this patent is extended or adjusted under 35 U.S.C. 154(b) by 0 days.

(21) Appl. No.: 17/044,573

(22) PCT Filed: Apr. 5, 2019

(86) PCT No.: PCT/GB2019/051014

§ 371 (c)(1),
(2) Date: Oct. 1, 2020

(87) PCT Pub. No.: WO2019/193368

PCT Pub. Date: Oct. 10, 2019

(65) Prior Publication Data

US 2021/0095220 A1 Apr. 1, 2021

(30) Foreign Application Priority Data

Apr. 6, 2018 (GB) ..... 1805779

(51) Int. Cl.
*C10M 133/06* (2006.01)
*C10M 129/06* (2006.01)
(Continued)

(52) U.S. Cl.
CPC ..... *C10M 133/06* (2013.01); *C10M 129/06* (2013.01); *C10M 169/04* (2013.01);
(Continued)

(58) Field of Classification Search
CPC ..... C10M 133/06; C10M 129/06; C10M 169/04; C10M 2207/021; C10M 2215/04;
(Continued)

(56) References Cited

U.S. PATENT DOCUMENTS

2006/0201600 A1 9/2006 Kollin
2010/0105590 A1* 4/2010 Nagakari ..... C10M 141/00 508/508

(Continued)

FOREIGN PATENT DOCUMENTS

EP 2698419 A1 2/2014
GB 964268 A 7/1964

(Continued)

OTHER PUBLICATIONS

International Search Report and Written Opinion issued in PCT/GB2019/051014 mailed Jun. 24, 2019.
Great Britain Combined Search and Examination Report issued in Great Britain Application No. GB1805779.4 dated Oct. 1, 2018.

(Continued)

*Primary Examiner* — Prem C Singh
*Assistant Examiner* — Francis C Campanell
(74) *Attorney, Agent, or Firm* — Heslin Rothenberg Farley & Mesiti P.C.

(57) ABSTRACT

A lubricant composition said composition comprising at least one base oil and from 1 to 70 wt % of at least one friction modifying additive, wherein the composition is such that the viscosity reversibly reduces at a pressure from 50 MPa to 3 GPa. A mechanical system comprising the lubricant composition; use of the lubricant composition and methods of reducing friction using the lubricant composition are also disclosed.

22 Claims, 7 Drawing Sheets

(51) Int. Cl.

| | |
|---|---|
| ***C10M 169/04*** | (2006.01) |
| *C10N 30/00* | (2006.01) |
| *C10N 30/02* | (2006.01) |
| *C10N 30/06* | (2006.01) |
| *C10N 40/02* | (2006.01) |
| *C10N 40/04* | (2006.01) |
| *C10N 40/08* | (2006.01) |
| *C10N 40/25* | (2006.01) |
| *C10N 40/30* | (2006.01) |
| *C10N 50/10* | (2006.01) |

(52) U.S. Cl.
CPC ..... *C10M 2207/021* (2013.01); *C10M 2215/04* (2013.01); *C10N 2030/02* (2013.01); *C10N 2030/06* (2013.01); *C10N 2030/58* (2020.05); *C10N 2040/02* (2013.01); *C10N 2040/04* (2013.01); *C10N 2040/08* (2013.01); *C10N 2040/25* (2013.01); *C10N 2040/30* (2013.01); *C10N 2050/10* (2013.01)

(58) Field of Classification Search
CPC ..... C10M 2215/041; C10M 105/12; C10M 105/60; C10M 171/00; C10N 2030/58; C10N 2030/02; C10N 2030/06; C10N 2040/02; C10N 2040/04; C10N 2040/08; C10N 2040/25; C10N 2040/30; C10N 2050/10
USPC ..... 508/545
See application file for complete search history.

(56) References Cited

U.S. PATENT DOCUMENTS

| | | | | |
|---|---|---|---|---|
| 2014/0020886 | A1 | 1/2014 | Falkner et al. | |
| 2016/0186084 | A1 | 6/2016 | Schilowitz et al. | |
| 2017/0145336 | A1 | 5/2017 | Forbus, Jr. | |
| 2019/0144776 | A1* | 5/2019 | Famg | C10M 149/14 508/563 |
| 2020/0299603 | A1* | 9/2020 | Champagne | C10M 169/04 |

FOREIGN PATENT DOCUMENTS

| | | | |
|---|---|---|---|
| JP | S63393 | A | 1/1988 |
| JP | 2000080390 | A | 3/2000 |
| WO | 2014085520 | A1 | 6/2014 |
| WO | 2016179224 | A1 | 11/2016 |
| WO | 2018210829 | A1 | 11/2018 |
| WO | 2018210829 | A8 | 11/2018 |

OTHER PUBLICATIONS

Jürgen Schmelzer et al., "Vapour -liquid equilibria and heats of mixing in n-alkane-1-alcohol systems. III. Vapour-liquid equilibria in n-alkane-1-dodecanol systems," Fluid Phase Equilibria, vol. 15, No. 1, pp. 107-119, Jan. 1, 1983.

Peng Wang et al., "Wall slip in an EHL contact lubricated with 1-dodecanol," Tribology International, vol. 113, pp. 197-205, 2016.

Communication pursuant to Article 94(3) EPC in European Application No. 19717589.6. Aug. 2, 2021.

Communication Pursuant to Article 94(3) EPC in European Application No. 19717589.6, dated Sep. 27, 2023.

Communication Under Rule 71(3) EPC (Intention to Grant) in European Application No. 19717589.6, dates Aug. 8, 2024.

* cited by examiner

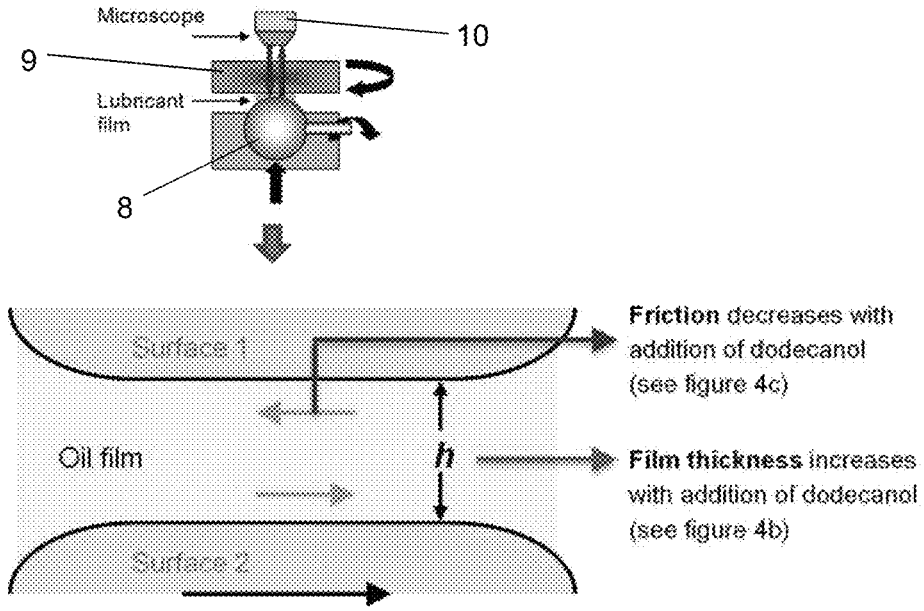
Figure 3a
Figure 3b
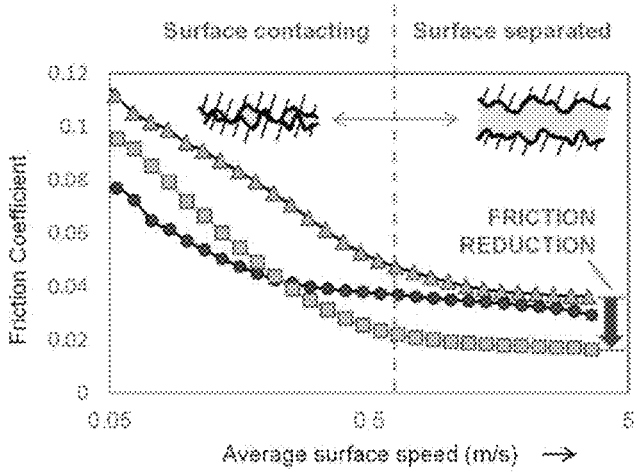
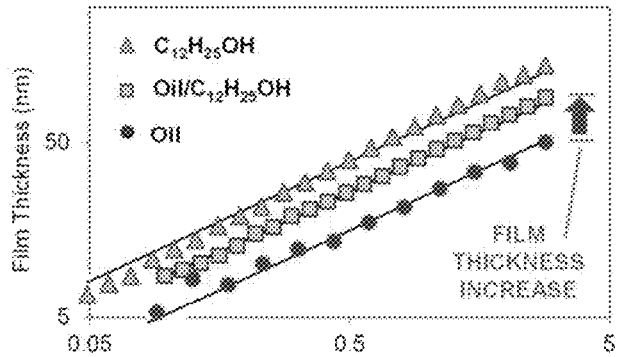
Figure 3c

LUBRICANT COMPOSITIONS

CROSS REFERENCE TO RELATED APPLICATIONS

This application is a U.S. National Phase filing under 35 U.S.C. § 371 of International Application PCT/GB2019/051014, filed Apr. 5, 2019, and published as WO 2019/193368 A1 on Oct. 10, 2019. PCT/GB2019/051014 claims priority from Great Britain patent application number 1805779.4, filed Apr. 6, 2018. The entire contents of each of these prior applications are hereby incorporated herein by reference.

FIELD

The present invention relates to lubricant compositions, and in particular lubricant compositions for lubricated components.

BACKGROUND

Lubricants are of paramount importance to increase the efficiency of mechanical systems and thereby reduce energy consumption. This is required both to help meet UK $CO_2$ emission limits and, in global terms, to mitigate the impact on the environment of greatly increased machine use in developing countries.

There are a number of strategies for increasing the efficiency of machines, including the development of novel designs and the reduction of mass of moving parts. However, one of the most generic and productive approaches is to reduce mechanical friction. For several years, this has been achieved by using lubricants of lower viscosity, as this reduces fluid film friction losses. Unfortunately, this trend is constrained, since excessive reductions in viscosity lead to thinner lubricant films, which in turn lead to more severe solid-solid rubbing contact, more surface damage and shorter component lives.

Most liquid lubricated bearing components work by hydrodynamic lubrication, whereby lubricant is dragged into the contact due to the motion of the surfaces. Due to the lubricant's viscosity, this entrainment results in an increase in pressure which pushes the surfaces apart to form fluid film which reduces friction.

Rolling bearings and gears are the most common components where energy is dissipated (the number of rolling element bearings currently in operation is over 50 billion). These components have counter-formal contacts (i.e. they involve contacts between surfaces which do not conform to one another without being deformed). This leads to contact areas between sliding surfaces being very small (for example, around 200 microns in width/diameter) which result in extremely high pressures (in the gigapascal range). For a standard passenger car, the energy loss due to viscous shearing of the oil film within the high-pressure region of such contacts is estimated to consume around 5.9% of the vehicle's total fuel energy.

When lubricated by piezoviscous fluids, such as oils, these conditions give rise to hard elastohydrodynamic lubrication (EHL), which is a subset of hydrodynamic lubrication that exhibits elastic deformation of the component surfaces and a significant increase in lubricant viscosity.

SUMMARY

The lubricant compositions of the present invention are for elastohydrodynamic lubrication. These compositions are intended mostly for non-conforming surfaces (also described herein as counter-formal contacts) or higher load conditions, where the bodies suffer elastic strains at the contact. Such strain creates a load-bearing area, which provides an almost parallel gap for the fluid to flow through. A counter-formal contact is formed when the curvature of an interface surface of a moving component (i.e. the surface at which the component interfaces with a surface of another component) does not match the curvature of an interface surface of a component which it moves relative to. As a result, the contact area between the two interface surfaces is usually small. If the curvatures of the interface surfaces do not match in both principal directions, a point contact or elliptical contact is formed (for example, the contact area between a sphere and a flat surface). If the curvatures of the interface surfaces match in one principal direction but not in another principal direction, a line contact is formed (for example, the contact area between a cylinder and a flat surface). The pressures that may be found in the contact area between such non-conforming surfaces are typically 50 MPa or greater, for example at least 100 MPa, at least 150 MPa, at least 200 MPa, at least 500 MPa or at least 1 GPa.

Non-conformal contacts as described herein may be found in, for example, gears, bearings, cams and pistons.

Much as in hydrodynamic lubrication, the motion of the contacting bodies generates a flow-induced pressure, which acts as the bearing force over the contact area. In such high-pressure regimes, the effective viscosity of the fluid may rise considerably. In full film elastohydrodynamic lubrication, the generated lubricant film completely separates the surfaces. Full film lubrication occurs when there is a continuous lubricating film between a first surface and a second surface which moves relative to the first surface, wherein the continuous lubricating film is thick enough to completely separate the two surfaces. In contrast, when there is contact between raised solid features, or asperities, a mixed-lubrication or boundary lubrication regime occurs. Therefore, in order for full-film conditions to be met, the lubricating film must be thicker than the height of the asperities. In the full film regime, as the speed of the moving surfaces and/or the viscosity of the lubricant increase, the friction coefficient and film thickness increase. The lubricant compositions of the present invention have advantages over those of the prior art in that they function in the full film regime as well as in the mixed regime.

In addition to the Reynolds equation, elastohydrodynamic theory considers the elastic deflection equation, since in this regime elastic deformation of the surfaces contributes significantly to the lubricant film thickness.

Due to the conservation of flow, lubricant film thickness under elastohydrodynamic conditions is determined by conditions at the inlet as oil enters the contact, where pressures are relatively low (for example at around 70 MPa or, as an alternative example, at around 150 MPa). This is because there is negligible side-leakage, so that, once the lubricant is entrained between the surfaces at the inlet, it cannot escape and must flow through the contact. However, EHL friction (also known as traction) results from shearing within the contact where pressures can be in the GPa range (since friction arises from the region of the interface which supports the applied load). The fact that friction and film thickness in elastohydrodynamic contacts are determined by fluid properties in two different locations is key to this invention. This is because such contacts have high contact pressures which are sufficient to form hydrogen bonding in the friction-modifying additive.

The lubricant compositions of the present invention are of particular use in piezoviscous-elastic contacts (also known as hard elastohydrodynamic lubrication). Piezoviscous-elastic contacts will occur for, e.g., non-conformal contact where the surfaces are formed from hard materials such as steel or ceramics. For point, elliptical and line contacts, the piezoviscous-elastic regime can be defined as follows. In order for a contact between two surfaces (1, 2) to be in this regime, it must fulfil all of the following conditions:

$$g_v > \left(\frac{k_3}{k_5}\right)^{\left(\frac{1}{0.53}\right)} g_E^{\left(\frac{(0.67-0.13)}{0.53}\right)} \quad [1]$$

$$g_v > \left(\frac{k_1}{k_5}\right)^{\left(\frac{1}{0.53}\right)} g_E^{\left(\frac{-0.13}{0.53}\right)} \quad [2]$$

$$g_v > \left(\frac{k_2}{k_5}\right)^{\left(\frac{1}{0.53}\right)} g_E^{\left(\frac{(0.67-0.13)}{0.53}\right)} \quad [3]$$

where $$k_1 = 128(0.955k)\left(\frac{1}{1+\frac{0.698}{k}}\right)^2\left(0.13\tan^{-1}\left(\frac{0.955k}{2}\right)+1.683\right)^2$$

$$k_2 = 1.66(1-e^{-0.68k})$$

$$k_3 = 11.15(1-0.72e^{-0.28k})$$

$$k_5 = 3.61(1-0.61e^{-0.73k})$$

and $k = R'_y / R'_x$.

The viscosity parameter, $g_v$, may be determined according to the following equation:

$$g_v = \frac{\overline{G}\overline{W}^3}{\overline{U}^2}$$

The elasticity parameter, $g_E$, may be determined according to the following equation:

$$g_E = \frac{\overline{W}^{8/3}}{\overline{U}^2}$$

where the speed parameter $$\overline{U} = \frac{U\eta_0}{E'R'_x}$$

the materials parameter $$\overline{G} = \alpha E'$$

and the load parameter $$\overline{W} = \frac{W}{E'R'^2_x}$$

U is the entrainment velocity (in m/s) and is half the sum of the velocities of the two surfaces relative to the contact. W is the total normal load of the contact (in N).

$R'_x$ and $R'_y$ are the reduced radii (in m) of the contact in the x and y planes, respectively. They can be calculated by measuring the principal radii (x, y) of the contact areas on each surface (1, 2) of the contact: $R_{x1}$ $R_{x2}$ $R_{y1}$ $R_{y2}$ $$\frac{1}{R'_x} = \frac{1}{R_{x1}} + \frac{1}{R_{x2}}$$

$$\frac{1}{R'_y} = \frac{1}{R_{y1}} + \frac{1}{R_{y2}}$$

E' is the reduced Young's Modulus (in Pa):

$$\frac{2}{E'} = \frac{(1-\nu_1^2)}{E_1} + \frac{(1-\nu_2^2)}{E_2}$$

where $E_1$ and $E_2$ are the elastic moduli of solids of the surfaces (1, 2) and $\nu_1$ and $\nu_2$ are the Poisson's ratio of solids of the surfaces (1, 2). The elastic moduli of surfaces may be determined using the Standard Test Method for Young's Modulus according to Active Standard ASTM E111.

The Poisson's ratio of solids may be determined by the Standard Test Method for Poisson's Ratio at Room Temperature according to Active Standard ASTM E132.

The dynamic fluid viscosity, $\eta_o$, at atmospheric pressure (at shear rate and temperature of inlet) (in Pa·s) may be determined by the Standard Test Method for Dynamic Viscosity of Liquids by Stabinger Viscometer according to Active Standard ASTM D7042.

The pressure viscosity coefficient, $\alpha$, (1/Pa) may be determined according to the WAM Pressure-Viscosity Coefficient Measurement SAE ARP6157.

Measurement of viscosity, and related properties as discussed above, may be carried out at room temperature (20-25° C., e.g. 20° C.) or at a temperature relevant to an intended operating component. For example, measurements may be made at 100° C.

This invention provides an improvement to the current friction reduction strategy of simply decreasing oil viscosity at ambient pressure and has an advantage of not reducing the film thickness, which has been a limiting constraint.

By contrast, another prior art method of reducing oil film friction is to use an oil with an inherently low high pressure viscosity coefficient (highly refined oil). The friction-modifying additive used in this invention has the advantage that it gives larger friction reductions and may be used in combination with low friction lubricants. A friction modifying additive as referenced herein may also be referred to as a friction reducing additive.

The reductions in friction possible using the present invention are substantial and do not require complicated redesigning of machines.

By adding at least one friction-modifying additive which comprises at least one functional group capable of hydrogen bonding to a base oil it is possible to produce a lubricant which has a significantly reduced effective viscosity when subjected to high pressures. Meanwhile, the viscosity of the lubricant at low pressure either remains unchanged (i.e. the resulting blend exhibits a reduction (which may, for example, be a rapid reduction) in effective viscosity at a certain threshold pressure, which is greater than the pressure at the inlet of the contact where the film thickness in the contact is determined), or exhibits an increase as a result of the friction-modifying additive, wherein the increase in viscosity can be offset by using a different base oil (i.e. a base oil of lower viscosity) in the lubricant. If the addition of the friction-modifying additive results in an increase in viscosity at low pressure which is offset by using a lower viscosity base oil in the lubricant, a further reduction in the viscosity of the lubricant at high pressure may be achieved (i.e. as a result of the lower viscosity base oil).

By "capable", it is intended to mean that the functional group of the at least one friction-modifying additive comprises a hydrogen atom bonded to an electronegative atom. However, below a critical pressure, this functional group is incapable of forming intermolecular hydrogen bonds as the group is sterically hindered (i.e. other atoms in the molecule get in the way so that the hydrogen atom from one molecule and the electronegative atom from another cannot get close enough to form a bond). As the pressure increases, the molecules deform (intramolecular bonds rotate) and when the critical pressure reached is reached, it has deformed sufficiently that intermolecular hydrogen bonding can take place. From literature, the maximum separation between electronegative atoms to allow H-bonding seems to be 2.8 Angstrom. This means that under full film conditions, frictional dissipation within the contact area is reduced, while the film thickness (which is determined in the lower pressure inlet region) remains unchanged. In all other known cases, viscosity increases monotonically with pressure. However, the Applicants have surprisingly found lubricant compositions which have a viscosity which decreases with increasing pressure.

Infrared spectroscopy measurements made of the molecular characteristics of the lubricant additives, which show a reduction in viscosity with pressure above a threshold pressure, provide evidence that hydrogen bonding between the additive molecules is responsible for this behaviour. A hydrogen bond is an electrostatic attraction between two polar groups that occurs when a hydrogen (H) atom, bound to a highly electronegative atom such as nitrogen (N), oxygen (O), or fluorine (F), experiences the electrostatic field of another highly electronegative atom that is nearby.

This proposed method of mixing one or more specific friction-modifying additives with a base oil to provide a lubricant composition to reduce viscous friction can be applied to any lubricant that operates under elastohydrodynamic lubrication.

The lubricant compositions according to the present invention are preferably not used for components such as journal bearings and seals, with interfaces lubricated under purely hydrodynamic contacts (also known as isoviscous-rigid contacts). This is because in these components, 1) the pressures are not high enough to induce hydrogen bonding between the additives to reduce the viscosity, 2) the region of the interface where friction is generated coincides with the region where the properties of the lubricant determine the film thickness coincides.

The lubricant compositions according to the present invention are advantageous because they reduce fluid film friction (viscous dissipation). All other friction reducing oil additives work by forming slippery surface films and reduce friction when surfaces come into contact. For the additive to be effective, the load applied to the contact must be borne at least partially by the lubricating fluid (this occurs under high speed and high viscosity conditions where sufficient lubricant is entrained to separate the surfaces). The mechanism according to this invention is ineffective under boundary lubrication conditions where the applied load is supported by solid-solid contact and friction arises from shearing these conjunctions.

Preferably, the lubricant compositions according to the present invention are not used in components such as metal cutting (grinding, milling, turning etc.) since friction in these components arises predominantly from solid-solid contact (since by definition, surface contact must take place in order to remove material) so there is negligible fluid friction to be reduced.

Conventional friction modifiers work by forming slippery surface films and therefore a much lower concentration is typically required (<1%), since surface films require relatively few additives molecules dissolved in a fluid to form a complete surface film. By including a friction modifying additive, as defined herein, this improves in performance with increasing concentration. This is because they modify the bulk viscosity of the fluid.

According to the present invention, there is provided a lubricant composition, comprising: at least one base oil; and from 1 to 70 weight % of at least one friction modifying additive, wherein the composition is such that the viscosity reversibly reduces at a pressure from 50 MPa to 3 GPa. Also provided herein is a lubricant composition comprising at least one base oil and from 1 to 70 wt % of at least one friction modifying additive, wherein the friction modifying additive comprises at least one functional group capable of hydrogen bonding.

The viscosity of the present invention reduces once the blend reaches a critical pressure of between 50 MPa to 3 GPa. The reduction in viscosity may be an abrupt reduction. That is, this reduction in viscosity may happen very quickly (for example, in less than a microsecond). By "reversibly reduces" this means that under high pressure the viscosity reduces, and then when the pressure is reduced, the viscosity increases again.

The pressure exerted on the lubricant composition may be a compressive normal stress.

A friction modifying additive as disclosed herein may comprise at least one functional group capable of hydrogen bonding. A lubricant composition as disclosed herein comprises at least one friction modifying additive and, therefore, may comprise a single friction modifying additive or a mixture of friction modifying additives. It is to be understood that reference to "the friction modifying additive" herein is intended to refer to "each friction modifying additive, independently" when a mixture of such friction modifying additives is present. The friction modifying additive may comprise a hydrocarbon chain substituted with at least one functional group capable of hydrogen bonding. At least one functional group capable of hydrogen bonding may be present as a substituent on a primary, secondary or tertiary carbon atom, preferably on a primary carbon atom. The hydrocarbon chain may be substituted with a single functional group capable of hydrogen bonding. Each functional group capable of hydrogen bonding may, independently, be an alcohol functional group, a carboxylic acid functional group or an amine functional group (e.g. —$NH_2$ or —NHR, preferably —$NH_2$). The friction modifying additive may comprise at least one alcohol functional group or at least one amine functional group. The hydrocarbon chain may be straight chained, branched, cyclic or a combination thereof. Moreover, the hydrocarbon chain may be fully saturated or it may contain one or more double or triple bonds. The hydrocarbon chain may optionally be further substituted, for example with one or more substituents selected from —F, —OR, —CN, —C(O)OR or —$N(R)_2$. R as referenced herein may be alkyl, alkenyl or alkynyl, for example having 1-20, 1-12, 1-6 or 1-3 carbon atoms.

The hydrocarbon chain may comprise at least 8 carbon atoms, for example at least 10 carbon atoms. The hydrocarbon chain may, for example, comprise from 8 to 30 carbon atoms, from 10 to 20 carbon atoms, from 10 to 19 carbon atoms or from 10 to 16 carbon atoms.

The friction modifying additive may comprise at least one alkylamine having a carbon chain length of at least 8 carbon atoms, or a mixture thereof.

The friction modifying additive may comprise an alcohol, wherein the carbon chain length of the alcohol is at least 8 carbon atoms.

Preferably, the at least one alcohol has a carbon chain length of from 8 to 30 carbon atoms. For example, the carbon chain length may be from 10 to 16 carbon atoms. More preferably still, the alcohol is a fatty alcohol selected from lauryl alcohol (dodecanol, 1-dodecanol), myristyl alcohol (1-tetradecanol) and stearyl alcohol (1-octadecanol), or mixtures thereof. In a preferred embodiment, the fatty alcohol is lauryl alcohol. Note that the chemical names and common names are used interchangeably throughout this document.

When the friction modifying additive comprises at least one alkylamine, the chain length of the alkylamine is preferably from 8 to 30 carbon atoms, preferably 10 to 16 carbon atoms. In preferred embodiment, the alkylamine is selected from dodecylamine, octadecylamine or mixtures thereof.

The properties of a lubricant composition may, in some instances, be optimised by choice of the at least one base oil and at least one friction modifying additive. Choice of hydrocarbon chain length in a friction modifying additive may allow optimisation for certain operating conditions, for example higher chain lengths may in some instances be selected for higher temperature applications, whereas shorter chain lengths may in some instances be selected for lower temperature applications, such as where a grease is used. Moreover, the at least one base oil and at least one friction modifying additive may be selected to optimise miscibility and/or solubility of the at least one friction modifying additive in the at least one base oil at a desired operating temperature. Solubility may be assessed by filling an ampoule with a mixture of solvent (base oil) and solute (additive), heating and cooling the ampoule in a thermostat and observing visually. The occurrence of clouding when changing from one phase to two phases determines the miscibility temperature. The miscibility temperature is preferably lower than a desired operating temperature. A lubricant composition as defined herein may, for example, have a miscibility temperature lower than 25° C. or lower than 20° C.

The addition of the at least one friction modifying additive has been found to reduce viscous friction whilst at the same time allowing film thickness to be increased. The above described friction modifying additive are advantageously used as friction modifying additives in this invention because they are sufficiently non-toxic, low cost, and are already being produced by major oil companies at a rate of millions of tonnes per year.

According to the present invention, at least one friction modifying additive is present in the composition in an amount from 1 to 70 wt %. The at least one friction modifying additive may be present in an amount of at least 5 wt %, at least 10 wt %, at least 24 wt %, at least 30 wt %, at least 35 wt %, at least 40 wt % or at least 45 wt %. Preferably, the additive is present in an amount from 25 to 70% by wt, 30 to 70% by wt, 30 to 65% by wt, 30 to 60% by wt or 35 to 55% by wt. More preferably, the additive is present in the composition in an amount from 40 to 55% by wt, 40 to 50% by wt or 45 to 50% by wt. Alternatively, the at least one friction modifying additive may be present in an amount up to 30 wt %, up to 20 wt %, up to 10 wt % or up to 5 wt %, for example, in an amount from 1 to 10 wt %, 1 to 5 wt %, or 5 to 10 wt %.

The lubricant composition according to the present invention comprises at least one base oil. The base oils used in formulating the lubricant compositions according to the present invention include conventional base stocks. According to the American Petroleum Institute (API), base oils fall into five main groups. This breakdown is based on the refining method and the base oil's properties in terms of, among other things, viscosity and the proportion of saturates and sulphur content.

Group I

The least refined type which produced by Solvent Refining. It usually consists of conventional petroleum base oils. API defines group I as "base stocks contain less than 90 percent saturates and/or greater than 0.03 percent sulfur and have a viscosity index greater than or equal to 80 and less than 120".

Group II

Better grade of petroleum base oil, which may be partially produced by hydrocracking. All impurities will be removed from the oil leading to clearer colour. API defines group II as "base stocks contain greater than or equal to 90 percent saturates and less than or equal to 0.03 percent sulfur and have a viscosity index greater than or equal to 80 and less than 120".

Group III

The best grade of petroleum base oil, since they are fully produced by hydrocracking, which make these oils purer. API defines group III as "base stocks contain greater than or equal to 90 percent saturates and less than or equal to 0.03 percent sulfur and have a viscosity index greater than or equal to 120". This group may be described as Synthetic Technology oils or hydro-cracked synthetic oil. However, some oil companies may call their products under this group as synthetic oil.

Group IV

Consists of synthetic oils made of Poly-alpha-olefins (PAO).

Group V

Any type of base oil other than mentioned in the previously defined groups. They include, among others, naphthenic oils and esters.

Preferably, the one or more base oils are selected from mineral oil, synthetic hydrocarbons, esters, polyglycols, natural oils, silicones, perfluoropolyethers and mixtures thereof. The lubricant composition may comprise a grease which comprises at least one base oil.

The main types of base oils suitable for use in the lubricant compositions of the present invention are mentioned below:

Main base fluid types

| Base fluid | Features | Uses |
|---|---|---|
| Mineral oil | cheap, wide viscosity range | Most applications |
| Synthetic hydrocarbons | high VI, high stability, low volatility | most-engine oils, gear oils, greases |
| Dibasic acid esters | high VI (usually), oxidatively stable, low pour point, biodegradable | gas turbine oils, greases, component in PAO-based engine oils |
| Polyol esters (type II esters) | high VI, very oxidatively stable, low pour point, biodegradable | gas turbine oils, compressor oils |

-continued

| Main base fluid types | | |
|---|---|---|
| Base fluid | Features | Uses |
| Oil soluble polyglycols | low friction, good burn off | worm gears textile lubrication |
| Water soluble polyglycols | water soluble | fire resistant hydraulic oils (ships, mining) |
| Natural fats/oils | low friction, very biodegradable (but often lower stability) | Metal forming fluids, Bio-degradable oils (chain saws, two strokes) |
| Phosphate esters | fire retardant, radiation resistant | aircraft hydraulics |
| Silicones | low volatility, very high VI, poor boundary lubrication | electrical oils |
| Perfluoropolyethers (PFPEs) | very temperature stable, very non-volatile | space, oxygen compressors, hard discs |

Depending on the intended use, the lubricant composition may also comprise additional additives, such as:

anti-wear additives
rust and corrosion inhibitors
detergents
dispersants and surfactants (which protect and clean metal surfaces)
viscosity index improvers and modifiers
seal swell additives and agents
anti-foam additives and anti-oxidation compounds
cold-flow improvers
high-temperature thickeners
gasket conditioners
pour point depressant The lubricant compositions of the present invention can be used to lubricate mechanical systems, such as gears, rolling element bearings (roller and ball bearings), cams and cam followers, and pistons.

Wt % values may be based on the total lubricant composition. The lubricant composition may be substantially absent of any emulsifier or surfactant, for example comprising less than 0.5 wt % or less than 0.4 wt % emulsifier or surfactant.

The one or more base oils may be present in the composition in an amount of from 25 to 95% of the total lubricant composition (blend). The at least one base oil and the at least one friction modifying additive of a lubricant composition as described herein may form at least 80 wt %, at least 90 wt %, at least 95 wt %, or at least 96 wt % of the total lubricant composition.

In one aspect of the present invention, the lubricant composition comprises a grease which comprises at least one base oil. Preferably, the lubricant composition according to the present invention is selected from grease, gear oil, engine oil, transmission fluid and hydraulic oil. As the skilled person will appreciate, other types of oils used in components that operate under elastohydrodynamic lubrication are also suitable.

Optionally, the lubricant composition additionally includes a corrosion inhibitor and/or an anti-foaming agent.

The composition according to the present invention has a viscosity at atmospheric pressure of between 1 and 500 cP at 100° C. (typically measured using a Stabinger or similar type viscometer). Viscosity (dynamic fluid viscosity) may be measured according to Active Standard ASTM D7042.

In a preferred embodiment, the lubricant composition is an elastohydrodynamic lubricant.

A liquid lubricant's primary job is to form a hydrodynamic or elastohydrodynamic film to separate sliding surfaces of components. The lubricant property that enables it to do this is its viscosity—the higher the viscosity, the thicker the oil film and the better protected the surface are. However, viscous friction also increases with viscosity. Therefore, viscosity of a lubricant is chosen for its application to be sufficiently high to generate a film which separates surfaces, but not excessively so that is causes unnecessary viscous drag. For example, slow moving, rough surfaces require higher viscosity lubricants whereas fast moving, smooth surfaces require lower viscosities. This means that it is important that the viscosity of the resulting blend meets the viscosity requirement of the particular application for which it is used.

Typically, the viscosity of an oil is achieved by selecting a base oil with the appropriate viscosity. In this invention, possible use of additives in high concentrations suggests an improved way to achieve the required viscosity. Specifically, the base oil viscosity can be left unchanged or reduced, while the viscosity and concentration of the friction modifying additive can be selected so that the resulting blend has the required viscosity. If for instance, fatty alcohols are used as additives in accordance with an embodiment of this invention it would be possible to control the viscosity of the blend, by using fatty alcohols of the required carbon chain length (since viscosity increases with chain length).

In accordance with a further aspect of the present invention, there is provided a mechanical system comprising gears and/or bearings, wherein the system comprises an elastohydrodynamic lubricant composition as defined above.

In accordance with another aspect of the present invention, there is provided apparatus comprising a first component having a first interface surface; a second component movable relative to the first component, the second component having a second interface surface; wherein the first interface surface interfaces with the second interface surface; the apparatus further comprising a lubricant composition provided to lubricate movement of the second interface surface relative to the first interface surface, wherein the lubricant composition comprises an additive which reduces the viscosity of the lubricant composition when the lubricant composition is compressed between the first and second interface surfaces.

The relative movement of the surfaces may result in a shear rate which is high enough to cause shear thinning of the lubricant composition. Under shear thinning conditions, the viscosity of the lubricant composition is not constant with shear rate and the lubricant composition has an effective viscosity which is dependent on the shear rate. In this case, the additive in the lubricant composition reduces the effective viscosity of the lubricant composition when the lubricant composition is compressed between the surfaces.

There may be substantially sliding relative movement of the first and second interface surfaces and the lubricant composition may be arranged to reduce contact between the first and second interface surfaces during the substantially sliding relative movement. The substantially sliding relative movement may result from sliding movement of the first interface surface relative to the second interface surface when a film of the lubricant composition is provided between the first and second interface surfaces. The first and second components may be components of a cam.

There may be substantially rolling relative movement of the first and second interface surfaces and the lubricant composition may be arranged to reduce contact between the first and second interface surfaces during the substantially rolling relative movement. The substantially rolling relative movement may result from rolling movement of the first interface surface relative to the second interface surface when a film of the lubricant composition is provided between the first and second interface surfaces. The first and second components may be components of a ball bearing. For example, the first component may be a bearing race and the second component may be a ball of the ball bearing. Alternatively, the first and second components may be gears. For example, the first interface surface may be a gear tooth profile on the first gear and the second interface surface may be a gear tooth profile on the second gear.

One of the first and second components may act on the respective other of the first and second components to exert a compressive stress on the lubricant composition. The compressive stress may have a vector component which is normal to the first and second interface surfaces. The compressive stress exerted on the lubricant composition may be at least 50 MPa, for example at least 100 MPa, at least 150 MPa, at least 200 MPa, at least 500 MPa or at least 1 GPa.

The compression of the lubricant composition between the first and second interface surfaces may be sufficient to cause elastohydrodynamic lubrication between the first and second interface surfaces.

The movement of the second component relative to the first component may result in a full film of the lubricant composition being provided between the first and second interface surfaces. That is, the second component may be arranged to move relative to the first component at a velocity which is sufficient to achieve full film lubrication between the first and second interface surfaces. The velocity required to achieve full film lubrication may be a sufficient velocity for a given viscosity of lubricant composition, stiffness of the first and second components, and geometry of the first and second components. There may be full film lubrication between the first and second interface surfaces when a thickness of the lubricant composition between the first and second interface surfaces is sufficient to prevent contact between the first and second interface surfaces. There may be full film lubrication between the first and second interface surfaces when a thickness of the lubricant composition between the first and second interface surfaces exceeds the surface roughness of the first interface surface and the second interface surface.

The first interface surface and the second interface surface may be counterformal. That is, the first interface surface may have a curvature which does not match the curvature of the second interface surface unless either the first interface surface or the second interface surface is deformed.

The lubricant composition may be a composition as described in the above paragraphs.

In accordance with a further aspect of the present invention there is provided a method of reducing friction in mechanical apparatus comprising a first component having a first interface surface and a second component movable relative to the first component, the second component having a second interface surface, wherein the first interface surface interfaces with the second interface surface, the method comprising: providing a lubricant composition to lubricate movement of the second interface surface relative to the first interface surface, wherein the lubricant composition comprises an additive which reduces the viscosity of the lubricant composition when the lubricant composition is compressed between the first and second interface surfaces; and compressing the lubricant composition between the first and second interface surfaces.

There may be substantially sliding relative movement of the first and second interface surfaces and providing the lubricant composition may comprise providing a lubricant composition that is arranged to reduce contact between the first and second interface surfaces during the substantially sliding relative movement.

There may be substantially rolling relative movement of the first and second interface surfaces and providing the lubricant composition may comprise providing a lubricant composition that is arranged to reduce contact between the first and second interface surfaces during the substantially rolling relative movement.

Compressing the lubricant composition between the first and second interface surfaces may comprise exerting a compressive stress on the lubricant composition by one of the first and second components acting on the respective other of the first and second components. The compressive stress may have a vector component which is normal to the first and second interface surfaces. Exerting the compressive stress on the lubricant composition may comprise exerting a compressive stress of at least 50 MPa, for example at least 100 MPa, at least 150 MPa, at least 200 MPa, at least 500 MPa or at least 1 GPa.

Compressing the lubricant composition between the first and second interface surfaces may comprise compressing the lubricant composition to cause elastohydrodynamic lubrication between the first and second interface surfaces.

Moving the second component relative to the first component may result in a full film of the lubricant composition being provided between the first and second interface surfaces. That is, the method may comprise arranging the second component to move relative to the first component such that there is full film lubrication between the first and second interface surfaces. That is, the method may comprise moving the second component relative to the first component at a velocity which is sufficient to achieve full film lubrication between the first and second interface surfaces.

The first interface surface and the second interface surface may be counterformal. The lubricant composition may be a composition as described in the above paragraphs.

In accordance with a further aspect of the present invention, there is provided apparatus comprising a first component having a first interface surface; a second component movable relative to the first component, the second component having a second interface surface; wherein the first interface surface interfaces with the second interface surface; the apparatus further comprising a lubricant composition provided to lubricate movement of the second interface surface relative to the first interface surface, wherein the lubricant composition comprises an additive comprising at least one functional group capable of hydrogen bonding. The lubricant composition may be a composition as described in the above paragraphs. Moreover, the apparatus may be an apparatus as described in the above paragraphs.

In accordance with a further aspect of the present invention, there is provided a method of reducing friction in mechanical apparatus comprising a first component having a first interface surface and a second component movable relative to the first component, the second component having a second interface surface, wherein the first interface surface interfaces with the second interface surface, the method comprising: providing a lubricant composition to lubricate movement of the second interface surface relative to the first interface surface, wherein the lubricant composition comprises an additive comprising at least one functional group capable of hydrogen bonding; and compressing the lubricant composition between the first and second interface surfaces. The lubricant composition may be a composition as described in the above paragraphs. Moreover, the method may be a method as described in the above paragraphs.

In accordance with an even further aspect of the present invention there is provided a method of reducing friction in a mechanical system between a first part and a second part moving relative to one another, by providing an elastohydrodynamic lubricant composition as described above between the first part and the second part. Preferably, wherein the rolling/sliding mechanical system includes, for example and not limited to, gears and/or bearings and/or cams and/or pistons.

According to the present invention, the lubricant composition as described above is used to reduce mechanical friction between moving parts, for example in a mechanical system as described herein. The lubricant composition is preferably used as a grease, engine oil, gear oil, transmission fluid, grease, turbine oil, compressor oil or hydraulic oil. The lubricant composition is preferably not mixed with water when used, for example in an apparatus, system or method as described herein.

Any use, method, system or apparatus described herein may comprise exerting a compressive stress of at least 50 MPa, for example at least 100 MPa, at least 150 MPa, at least 200 MPa, at least 500 MPa or at least 1 GPa on the lubricant composition.

It will be understood that various aspects and embodiments of a lubricant composition are described herein and that these various aspects and embodiments may be present in combination mutatis mutandis, both in the composition and also in the methods, uses, apparatus and systems described herein.

BRIEF DESCRIPTION OF FIGURES

The present invention will now be described, by way of example, with reference to the accompanying drawings, in which;

FIG. 3*a* is a schematic illustration of an oil film between two relatively moving parts, along with the Ultra-Thin Film Interferometry equipment used to measure film thickness and friction under elastohydrodynamic conditions;

FIG. 3*b* is a graph showing the coefficient of friction relative to average surface speed;

FIG. 3*c* is a graph showing film thickness relative to average surface speed;

DETAILED DESCRIPTION

Figure 1:
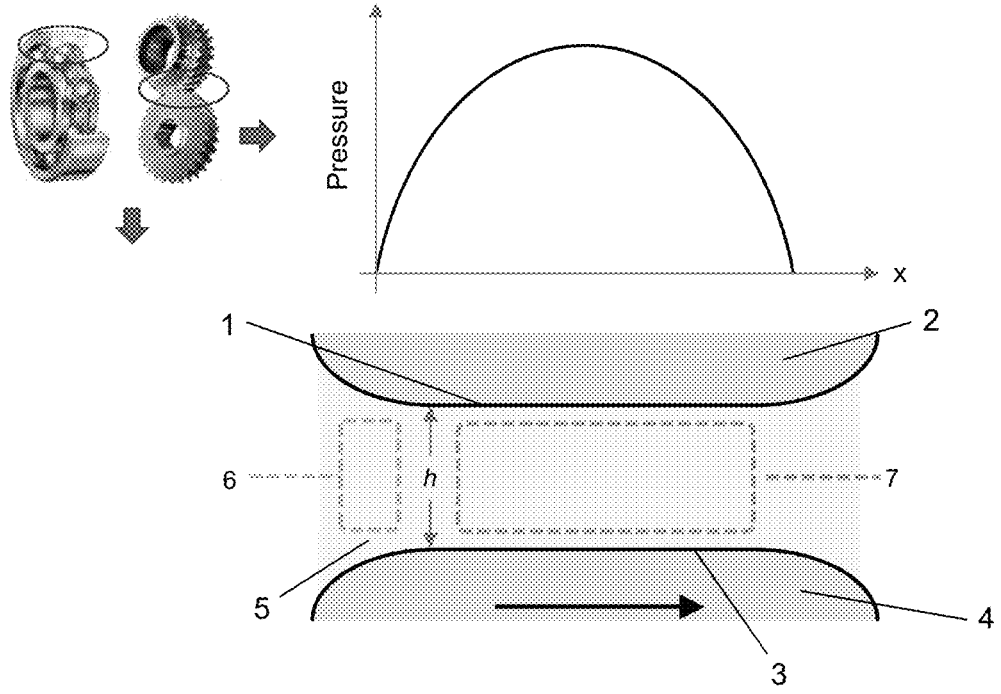
FIG. 1 is a schematic illustration of an oil film between two relatively moving parts.

FIG. 1 is a schematic illustration showing how a liquid film forms as oil is dragged through interfaces between sliding surfaces in a bearing or gear (hydrodynamic effect), and is subjected to ultra-high pressures. The viscosity at the low-pressure inlet is important since this causes the surfaces to be pushed apart by a film thickness, h, which prevents wear and seizure. The effective viscosity of the lubricant within the contact is important as it determines the energy loss due to frictional dissipation.

The first surface 1 in FIG. 1 is a surface of a first component 2. The second surface 3 in FIG. 1 is a surface of a second component 4. The second component 4 moves relative to the first component 2, meaning that the second surface 3 moves relative to the first surface 1 in the direction indicated by the arrow in FIG. 1. The first surface 1 interfaces with the second surface 3. A film 5 of lubricant composition is provided in between the first surface 1 and the second surface 3. The movement of the second surface 3 relative to the first surface 1 draws the lubricant composition through the interface between the first surface 1 and the second surface 2.

A first region 6 of the lubricant composition determines the thickness (indicated as 'h' in FIG. 1) of the film 5 of the lubricant composition. The first region 6 is an inlet region at relatively low pressure. The viscosity in the low pressure first region 6 determines the thickness h of the film 5 of lubricant composition.

A second region 7 of the lubricant composition determines the friction between the first surface 1 and the second surface 3. The friction between the first surface 1 and the second surface 3 is determined by the viscosity of the film 5 of the lubricant composition in the second region 7. The lubricant composition includes an additive which reduces the viscosity of the lubricant composition when the film 5 of lubricant composition is compressed between the first surface 1 and the second surface 3 (for example, in the form of a compressive stress exerted on the region 7 of the film 5 of lubricant composition by the second component 4 acting on the first component 2, or vice versa).

Figure 2:
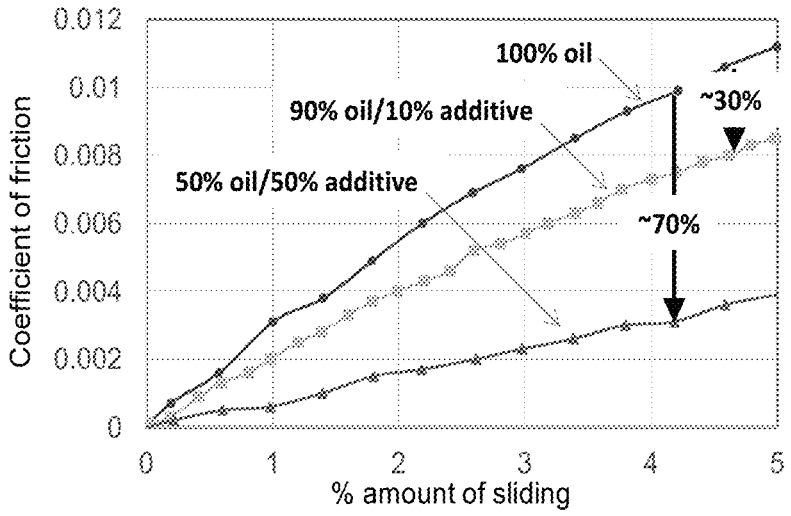
FIG. 2 is a graph showing the coefficient of friction relative to the amount of sliding

FIG. 2 is a graph showing the coefficient of friction for oil/additive blends, obtained using standard test equipment in which a ball (for example, the ball 8 shown in FIG. 3*a*) is rotated against a disc (for example, the disc 9 in FIG. 3*a*) to produce a contact similar to those found in bearings and gears (specifically, the equipment is a Mini-Traction-Machine (MTM), manufactured by PCS Instruments [LaFountain, A. R., Johnston, G. J., and Spikes, H. A. (2001), Tribology Transactions, 44, pp 648-656.]). The speed of rotation of both the ball and the disc can be varied to study lubricant behaviour. The results illustrated in FIGS. 2, 3*b*, 4, 5, 6, 7, 9, 10 were obtained using this test equipment for various lubricant compositions.

The results in FIGS. 2 and 3 use hexadecane as the model base oil.

FIG. 3*a* is a schematic illustration of an oil film between two relatively moving parts, observed using a microscope 10. The thickness of the film layer between the moving parts is shown as h. FIG. 3*a* also shows the test equipment referred to in relation to FIG. 2. The test equipment comprises a ball 8 which is rotated against a disc 9. A lubricant film is disposed between the ball 8 and the disc 9. The test equipment also comprises the microscope 10, which is used to observe the behaviour of the lubricant film between the ball 8 and the disc 9.

FIG. 3*b* is a graph showing the coefficient of friction relative to average surface speed (a Stribeck curve). As the average speed increases from zero and more liquid is entrained to separate the contacting surfaces, the coefficient of friction reduces. Therefore, in the left-hand region of the graph, friction arises from solid-solid contact where there is insufficient oil entrained to separate the surfaces. Conversely, on the right-hand side of the graph, friction arises due to shearing of the fluid as the surfaces are fully separated by oil. The graph shows the reduction in the coefficient of friction when using a lubricant composition of the invention. It is important to note that the friction is reducing in the full film region of the graph where the surfaces are completely separated by the oil.

FIG. 3*c* is a graph showing film thickness relative to average surface speed. Ordinarily, a reduction in viscous friction is accompanied by a decrease in film thickness. However, this is not the case for lubricant compositions of the invention. As shown, the lubricant compositions of the invention provide an increased film thickness as the average surface speed increases. FIG. 3*c* shows the film thickness relative to speed of movement of the parts (measured using an Ultra-Thin Film Interferometry, UTFI, rig from PCS Instruments). The addition of the additive to the oil unexpectedly reduces the friction while increasing the film thickness. In both cases the ball has a diameter of 19.05 mm; the applied load is 20 N and the contact is maintained at 40° C.

The results suggest that if this additive was blended with a car's engine and transmission oil at ratio of 1:10, the electrohydrodynamic friction (which accounts for ~5.9% of the total fuel energy [Holmberg)) would be would be reduced by ~30%.

Figure 4:
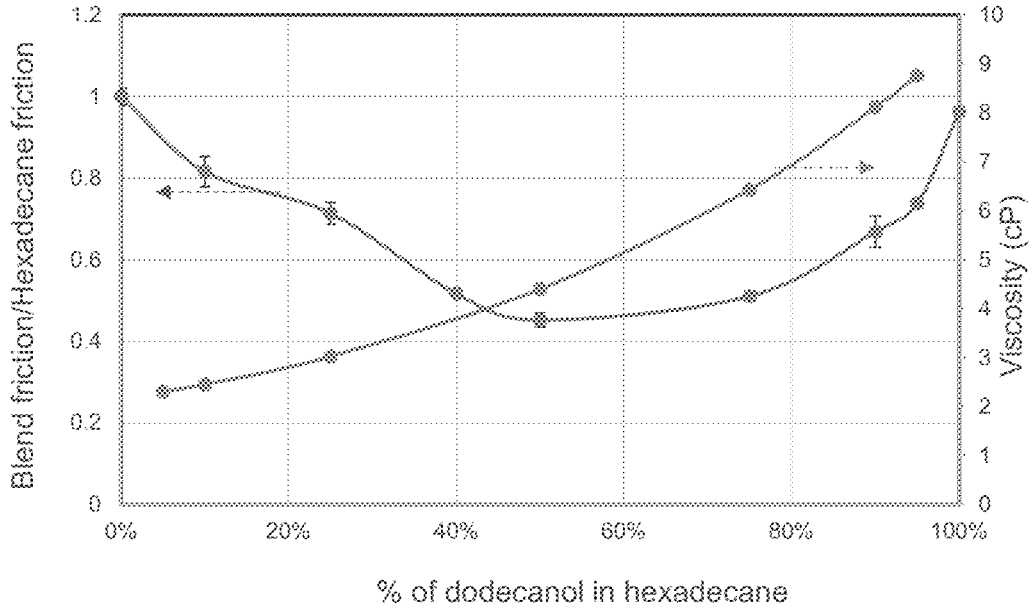
FIG. 4 is a graph showing the blend friction (full film) and viscosity for mixtures of dodecanol in hexadecane.

FIG. 4 is a graph showing the blend friction (plot indicated by arrow pointing to "blend friction/hexadecane friction" axis) and viscosity (plot indicated by arrow pointing to "viscosity" axis) for mixtures of dodecanol in hexadecane. The blend friction plot shows the change in blend friction at high pressure (i.e. where the pressure is high enough to cause hydrogen bonding in the dodecanol) against the relative amount of dodecanol, whereas the viscosity plot shows the change in viscosity at atmospheric pressure against the relative amount of dodecanol. Hexadecane is used as a model for a base oil. Dodecanol (lauryl alcohol) is a preferred friction-modifying additive. As the relative amount of dodecanol increase, the blend friction generally decreases. As the amount of dodecanol increases so it becomes the major component of the blend, the blend friction begins to increase again. There is also a general trend of increasing viscosity at atmospheric pressure with increasing amounts of the friction-modifying additive.

Figure 5:
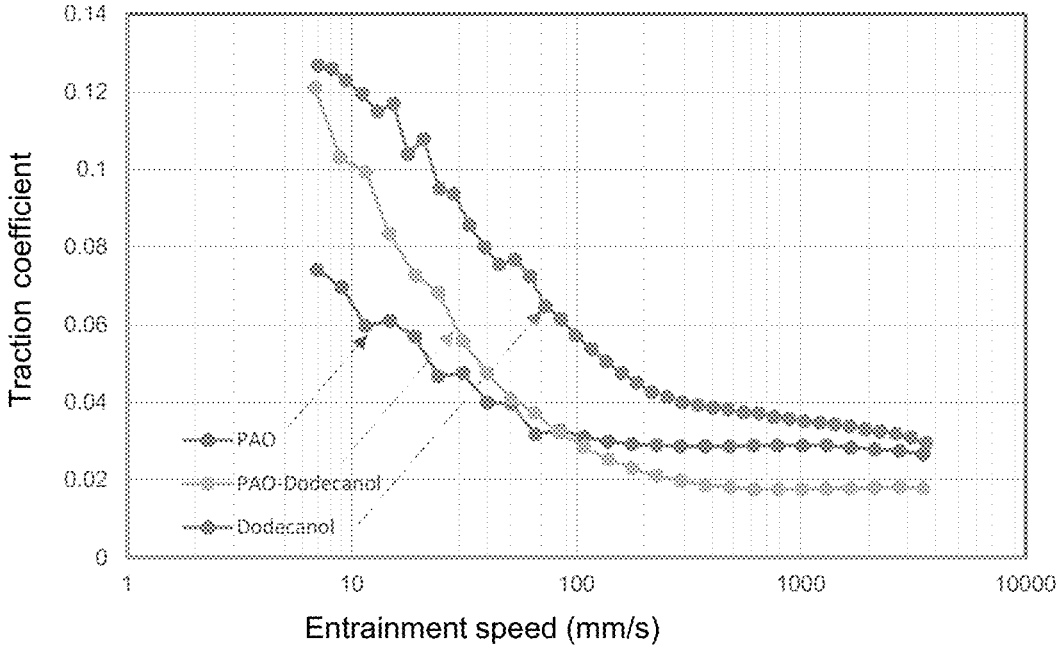
FIG. 5 is a graph showing the friction coefficient relative to entrainment speed for mixtures of PAO and dodecanol.

FIG. 5 is a graph showing the traction (friction) coefficient relative to entrainment speed (Stribeck curves) for mixtures of a poly alpha olefin (PAO) and dodecanol. The PAO is used as a model for a base oil (in this case it is a PAO6, having a kinematic viscosity of 6 cSt at 100° C.). The graph shows the marked reduction in the traction coefficient with increasing entrainment speed for a mixture of the PAO and dodecanol relative to the PAO and dodecanol alone.

Figure 6:
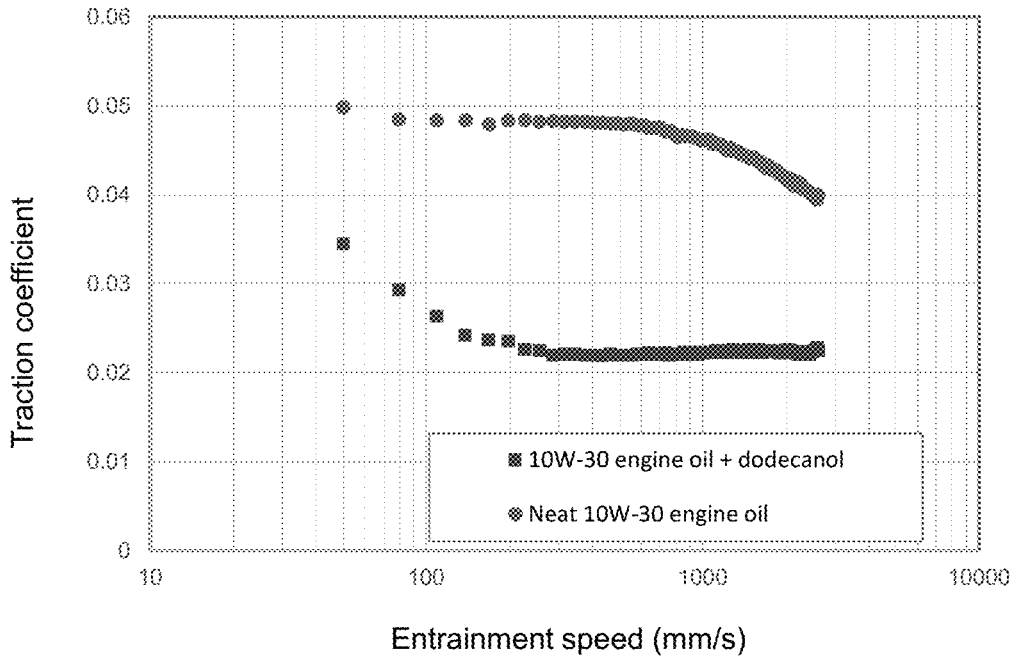
FIG. 6 is a graph showing friction coefficient relative to entrainment speed for an elastohydrodynamic contact, showing the effect of dodecanol when added to a commercial engine oil. It is to be noted that for a lubricated contact "friction" and "traction" are interchangeable and these terms are used interchangeable herein.

FIG. 6 is a graph showing the traction coefficient (friction) versus entrainment speed (Stribeck curve) for an elastohydrodynamic contact, showing the effect of dodecanol when added to a commercial engine oil. The graph below shows that the addition to dodecanol to a commercial engine oil (in this case a synthetic, fully formulated, 10W-30 oil) reduces the friction as least as well as when added to the pure hexadecane of PAO. This shows that the package of other lubricant additives present in the commercial engine oil do not interfere with the behaviour of the alcohol additive. This data was obtained on a Mini-Traction Machine (MTM) from PCS Instruments.

Figure 7:
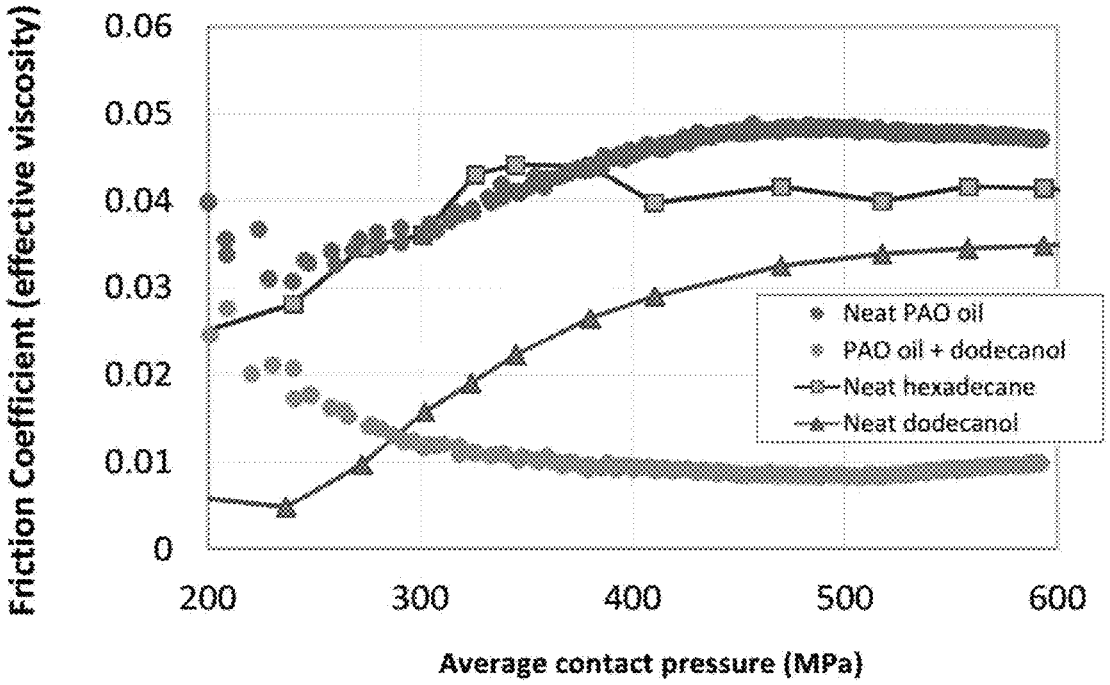
FIG. 7 is a graph showing the coefficient of friction (i.e. the effective viscosity) for a blend and a range of liquids as a function of the average contact pressure in the contact.

FIG. 7 is a graph showing the coefficient of friction (i.e. effective viscosity) of an EHL contact, versus the average contact pressure as a function of contact. As with FIGS. 3*b*, 4, 5 and 6, this has been obtained using a PCS Instruments MTM rig, which loads a ball against a disc to simulate a bearing contact. It can be seen here that the blend of dodecanol and PAO shows a coefficient of friction which reduces as the contact pressure increases. All other liquids show an increase in friction with pressure, which is classical behaviour.

Figure 8:
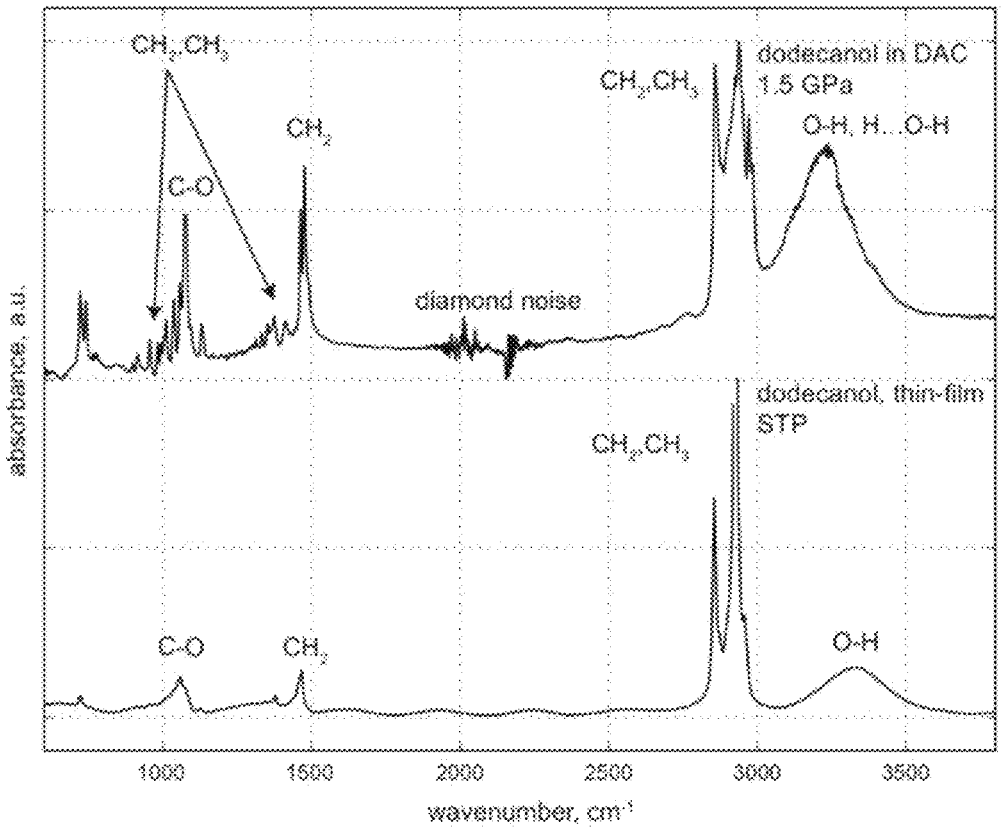
FIG. 8 shows an infrared absorption spectroscopy measurement made of a sample of pure dodecanol.

FIG. 8 is a graph showing the infrared absorption spectra obtained for pure dodecanol at ambient pressure and at 1.5 GPa (produced using a diamond anvil cell). For this measurement, the sample is held in a diamond anvil cell, which can compress the lubricant up to very high pressures, enabling the measurements to be obtained at ambient conditions and at 1.5 GPa. In this type of spectroscopy measurement, infrared light is used to excite vibrational modes of the sample molecule, providing information on the type of molecular bonding present. Comparing these two spectra shows: a) additional $CH_2$ and $CH_3$ peaks appearing at 1.5 GPa, and b) a broadening of the O—H peak at 1.5 GPa. Both of these features suggest solidification due to hydrogen bonding (Vasileva, A., et al. "FTIR spectra of n-octanol in liquid and solid states." Dataset Papers in Science 2014 (2014).).

Figure 9:
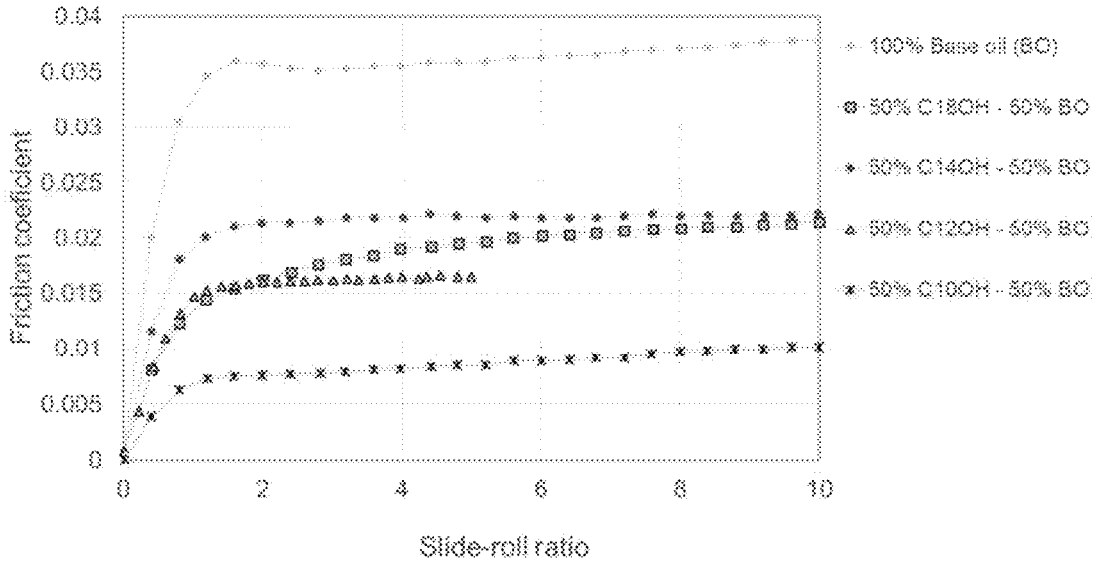
FIG. 9 is a graph showing traction curves, plotting the coefficient of fiction relative to slide roll ratio, for hexadecane only and for blends of hexadecane with fatty alcohols of varying chain length.

FIG. 9 is a graph showing traction curves, plotting the coefficient of fiction relative to slide roll ratio for hexadecane (base oil) only and for blends of hexadecane with straight chain fatty alcohols of varying chain length (C10, C12, C14 and C18). A traction curve plots friction against slide roll ratio, which is the relative speed (i.e. sliding speed) of the two surfaces divided by the entrainment speed. Usually a traction curve is produced by keeping the entrainment speed contact (and sufficiently high to entrain fluid to completely separate the surfaces so that the contact is in the full film regime), while the sliding speed is varied (i.e. the average speed of the two surfaces is maintained constant while difference between the two surface speeds is increased—on surface speed is increased while the other is decreased). Going from left to right on the curve: friction is initially close to zero as the surfaces are not moving relative to one another and there is almost no friction. As the slide roll ratio increases, so does the amount of shearing the lubricant experiences and the friction increases. All blends tested showed a reduction in friction coefficient compared to that observed for base oil only.

Figure 10:
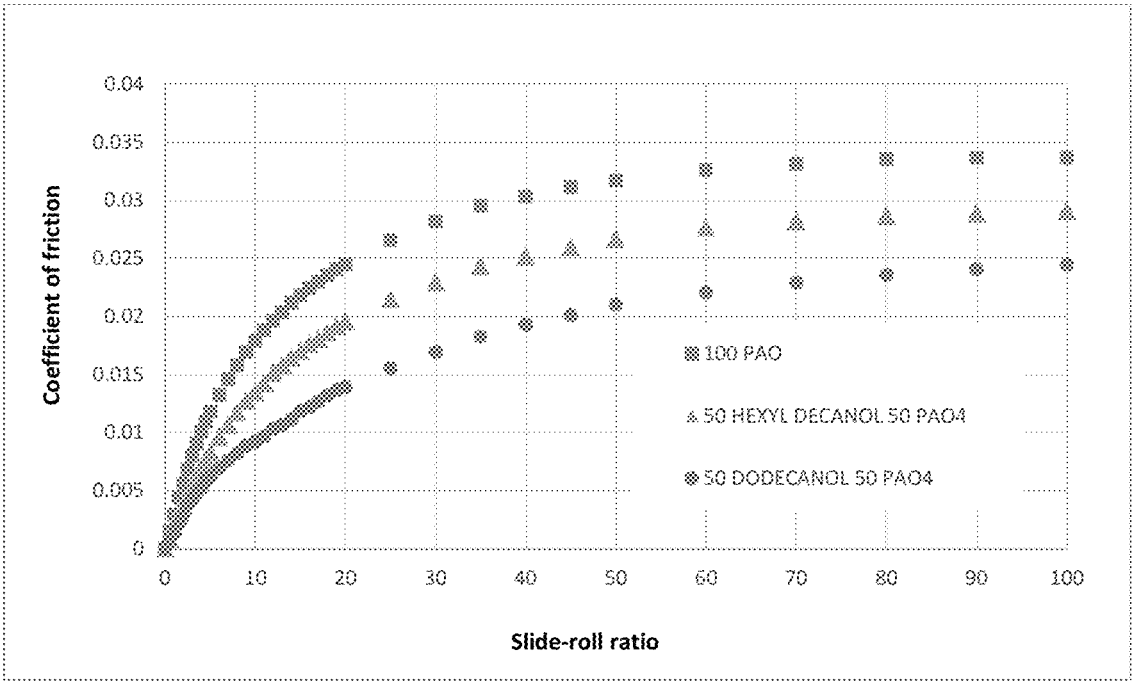
FIG. 10 is a graph showing traction curves, plotting the coefficient of fiction relative to slide roll ratio for PAO only, a 50:50 mixture of PAO and hexyl-decanol and a 50:50 mixture of PAO and dodecanol.

FIG. 10 is a graph showing traction curves for PAO only, and for dodecanol/PAO and 2-hexyl-1-decanol/PAO blends. Both blends tested exhibited friction reduction compared to PAO (base oil) alone. Corresponding tests were also carried out for blends of PAO with octadecylamine and stearic acid, respectively. With just 0.1 wt % additive present in these blends, friction reduction was observed.

Figure 11:
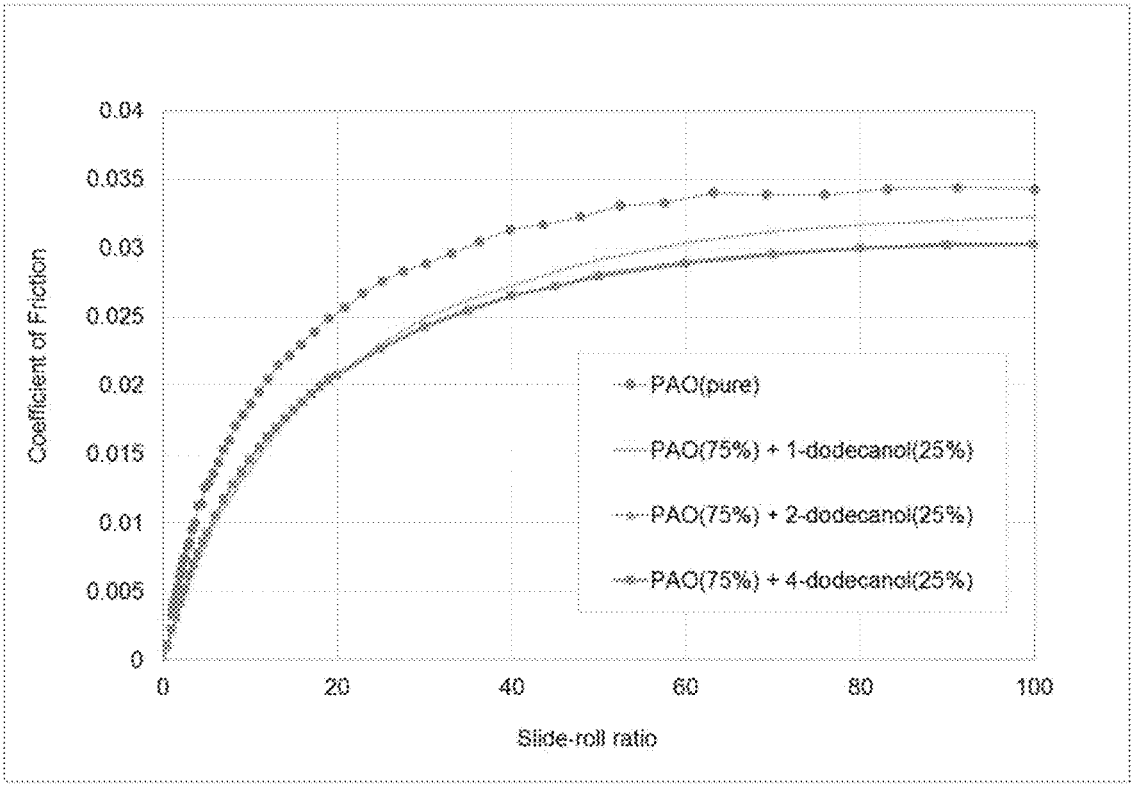
FIG. 11 is a graph showing traction curves, plotting the coefficient of fiction relative to slide roll ratio for PAO only, a 75:25 mixture of PAO and 1-dodecanol and a 75:25 mixture of PAO and 2-dodecanol and a 75:25 mixture of PAO and 4-dodecanol. (Note: elsewhere in this document 1-dodecanol is referred to simply as "dodecanol").

FIG. 11 is a graph showing traction curves for PAO only, and for 1-dodecanol/PAO and 2-dodecanol/PAO and 4-dodecanol/PAO blends. All three blends tested exhibited friction reduction compared to PAO (base oil) alone. (Note: elsewhere in this document 1-dodecanol is referred to simply as "dodecanol").

Figure 12:
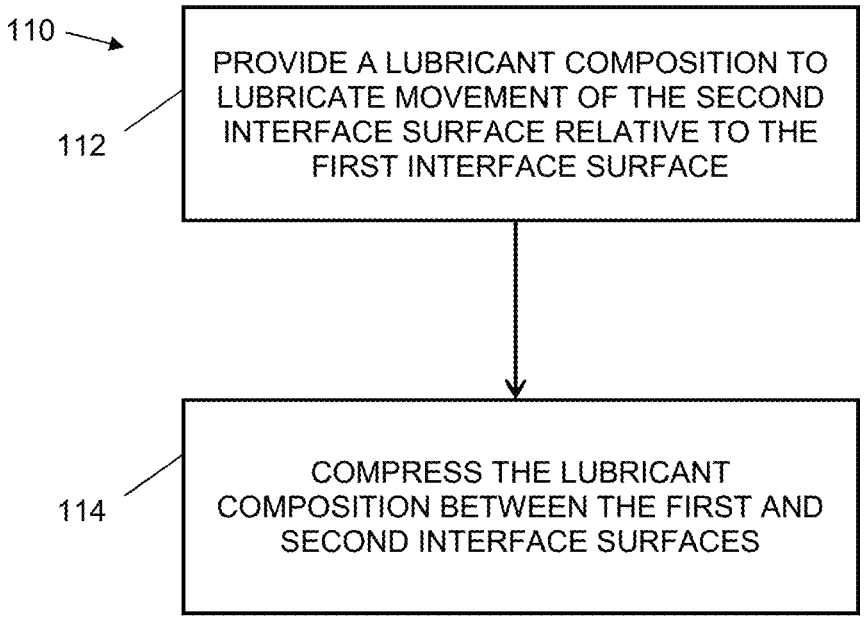
FIG. 12 is a flowchart of a method of reducing friction between two surfaces in mechanical apparatus.

FIG. 12 is a flowchart of a method 110 of reducing friction between two surfaces in mechanical apparatus. The method 110 reduces friction in mechanical apparatus comprising a first component having a first interface surface and a second component movable relative to the first component, wherein the second component has a second interface surface and the first interface surface interfaces with the second interface surface. For example, the method 110 reduces friction between the first surface 1 and the second surface 3 of the mechanical apparatus shown in FIG. 1.

At step 112, a lubricant composition is provided to lubricate movement of the second interface surface (e.g. the second surface 3 of the mechanical apparatus of FIG. 1) relative to the first interface surface (e.g. the first surface 1 of the mechanical apparatus of FIG. 1). The lubricant composition provided in step 112 comprises an additive which reduces the viscosity of the lubricant composition when the lubricant composition is compressed between the first and second interface surfaces.

At step 114, the lubricant composition is compressed between the first and second interface surfaces. Compression of the lubricant composition between the first and second interface surfaces causes the viscosity of the lubricant composition to be reduced, thereby reducing the friction between the first and second interface surfaces.

The invention claimed is:

1. A method of reducing friction in mechanical apparatus comprising a first component having a first interface surface and a second component movable relative to the first component, the second component having a second interface surface, wherein the first interface surface interfaces with the second interface surface, the method comprising:

providing a lubricant composition to lubricate movement of the second interface surface relative to the first interface surface, wherein the lubricant composition comprises at least one base oil and a friction modifying additive that comprises from 0.5 to 70 wt % of the lubricant composition and which reduces the viscosity of the lubricant composition when the lubricant composition is compressed between the first and second interface surfaces; and compressing the lubricant composition between the first and second interface surfaces;

wherein compressing the lubricant composition between the first and second interface surfaces comprises exerting a compressive stress on the lubricant composition by one of the first and second components acting on the respective other of the first and second components;

wherein exerting the compressive stress on the lubricant composition comprises exerting a compressive stress of at least 50 MPa; and wherein the friction modifying additive comprises a hydrocarbon chain of a length of from 8 to 30 carbon atoms only substituted with at least one alcohol functional group capable of hydrogen bonding, or comprises at least one alkylamine selected from dodecylamine or octadecylamine or mixtures thereof;

wherein the first component and second component are part of a rolling element bearing or gear; and wherein the lubricant composition is selected from gear oil, grease, transmission fluid and hydraulic oil.

2. A method according to claim 1, wherein:

a) there is substantially sliding relative movement of the first and second interface surfaces and wherein providing the lubricant composition comprises providing a lubricant composition that is arranged to reduce contact between the first and second interface surfaces during the substantially sliding relative movement; or b) there is substantially rolling relative movement of the first and second interface surfaces and wherein providing the lubricant composition comprises providing a lubricant composition that is arranged to reduce contact between the first and second interface surfaces during the substantially rolling relative movement.

3. A method according to claim 1, wherein:

a) the compressive stress has a vector component which is normal to the first and second interface surfaces; and/or b) exerting the compressive stress on the lubricant composition comprises exerting a compressive stress of at least 100 MPa.

4. A method according to claim 1, wherein compressing the lubricant composition between the first and second interface surfaces comprises compressing the lubricant composition to cause elastohydrodynamic lubrication between the first and second interface surfaces.

5. A method according to claim 1, further comprising moving the first component relative to the second component to provide a full film of the lubricant composition between the first and second interface surfaces.

6. A method of reducing friction in a mechanical system between a first part and a second part moving relative to one another, by providing a lubricant composition between the first part and the second part, wherein the lubricant composition comprises at least one base oil and from 0.5 to 70 wt % of at least one friction modifying additive, wherein the composition is such that the viscosity reversibly reduces at a pressure from 50 MPa to 3 GPa;

wherein the first part and second part are part of a rolling element bearing or gear;

wherein the lubricant composition is selected from gear oil, grease, transmission fluid and hydraulic oil; and wherein the friction modifying additive comprises a hydrocarbon chain of a length of from 8 to 30 carbon atoms only substituted with at least one alcohol functional group capable of hydrogen bonding, or comprises at least one alkylamine selected from dodecylamine or octadecylamine or mixtures thereof.

7. A method according to claim 1, wherein the lubricant composition comprises from 25 to 70 wt % of the at least one friction modifying additive.

8. A method according to claim 1, wherein the friction modifying additive comprises a hydrocarbon chain of a length of from 8 to 30 carbon atoms only substituted with at least one alcohol functional group capable of hydrogen bonding.

9. A method according to claim 1, wherein the friction modifying additive comprises at least one alkylamine selected from dodecylamine or octadecylamine or mixtures thereof.

10. A method according to claim 8, wherein the friction modifying additive is selected from the group consisting of lauryl alcohol, myristyl alcohol and stearyl alcohol, or mixtures thereof.

11. A method according to claim 1, wherein the lubricant comprises at least one base oil selected from mineral oil, synthetic hydrocarbons, esters, polyglycols, natural oils, silicones, perfluoropolyethers and mixtures thereof.

12. A method according to claim 1, wherein the lubricant composition comprises a grease which comprises at least one base oil.

13. A method according to claim 1, wherein the composition additionally includes one or more lubricant additives selected from anti-wear additives, rust and corrosion inhibitors, detergents, surfactants, viscosity index improvers and modifiers, seal swell additives and agents, anti-foam additives, anti-oxidation compounds, cold flow improvers, high-temperature thickeners, gasket conditioners, pour point depressants and greases.

14. A method according to claim 1, wherein the lubricant composition has a viscosity of between 1 and 500 cP at 100° C.

15. A method according to claim 1, wherein exerting the compressive stress on the lubricant composition comprises exerting a compressive stress of at least 500 MPa.

16. A method according to claim 1, wherein the first interface surface and the second interface surface are counterformal.

17. A method according to claim 1, wherein exerting the compressive stress on the lubricant composition comprises exerting a compressive stress of at least 200 MPa.

18. A method according to claim 1, wherein the lubricant composition comprises up to 30 wt % of the at least one friction modifying additive.

19. A method according to claim 1, wherein the composition is such that the viscosity reversibly reduces at a pressure from 50 MPa to 3 GPa.

20. A method according to claim 6, wherein the friction modifying additive comprises a hydrocarbon chain of a length of from 8 to 30 carbon atoms only substituted with at least one alcohol functional group capable of hydrogen bonding.

21. A method according to claim 20, wherein the friction modifying additive is selected from the group consisting of lauryl alcohol, myristyl alcohol and stearyl alcohol, or mixtures thereof.

22. A method according to claim 6, wherein the friction modifying additive comprises at least one alkylamine selected from dodecylamine or octadecylamine or mixtures thereof.

* * * * *